United States Patent [19]

Kloosterhouse

[11] Patent Number: 4,953,729

[45] Date of Patent: Sep. 4, 1990

[54] SANITATION SHIELD FOR WATER COOLER BOTTLE

[76] Inventor: George Kloosterhouse, P.O. Box 650, Malabar, Fla. 32950

[21] Appl. No.: 413,123

[22] Filed: Sep. 27, 1989

Related U.S. Application Data

[63] Continuation-in-part of Ser. No. 319,482, Apr. 12, 1989, abandoned.

[51] Int. Cl.[5] ..... B65B 3/04

[52] U.S. Cl. ..... 215/255; 141/364; 150/154; 206/616; 215/12.1; 215/257; 222/146.6; 222/541

[58] Field of Search ..... 215/256, 257, 255, 250, 215/258, 11.6, 12.1; 220/400; 383/67, 906; 425/813; 222/146.6, 543, 541; 239/24, 28, 29.3; 224/907; 150/154, 156; 141/18, 19, 349, 364

[56] References Cited

U.S. PATENT DOCUMENTS

| | | | |
|---|---|---|---|
| 1,320,862 | 11/1919 | Irey | 217/81 |
| 2,154,772 | 4/1939 | Rathemacher | 215/12.1 |
| 2,317,554 | 4/1943 | Risch | 215/12.1 |
| 2,607,345 | 8/1952 | Bachia et al. | 215/11.6 |
| 3,171,449 | 3/1965 | Ellms et al. | 141/364 |
| 3,645,413 | 2/1972 | Mitchell | 215/11.6 |
| 3,923,662 | 12/1975 | O'Brien | 62/319 X |
| 4,143,796 | 3/1979 | Williamson et al. | 383/67 X |
| 4,341,328 | 7/1982 | Redick, Jr. | 222/183 X |
| 4,573,204 | 2/1986 | Pollett | 383/906 X |
| 4,627,476 | 12/1986 | Wilcke | 141/364 |
| 4,699,188 | 10/1987 | Baker et al. | 215/250 X |
| 4,779,426 | 10/1988 | Desrosiers | 62/395 X |
| 4,782,967 | 11/1988 | Thomas | 215/257 X |
| 4,817,824 | 4/1989 | LaFleur et al. | 383/67 X |
| 4,834,267 | 5/1989 | Schroer et al. | 222/185 |
| 4,874,023 | 10/1989 | Ulm | 141/364 |

FOREIGN PATENT DOCUMENTS

| | | | |
|---|---|---|---|
| 158808 | 12/1939 | Austria | 215/257 |
| 815428 | 7/1936 | France | 215/257 |
| 17491 | 8/1911 | United Kingdom | 215/257 |
| 705816 | 4/1954 | United Kingdom | 215/257 |

*Primary Examiner*—Stephen Marcus

*Attorney, Agent, or Firm*—Evenson, Wands, Edwards, Lenahan & McKeown

[57] ABSTRACT

A water bottle sanitation shield covers the neck and shoulder regions of the bottle and effectively insulates the interior of the cooler tank from contaminants that may have accumulated on the bottle during transport and handling. The shield comprises film of non porous material that is secured around the mouth of the bottle by an annular retention cap. The film has a perforated region for placement over the mouth of the bottle and a pull cord attached to the perforated region. The film is sized so that, when the bottle is inverted and lowered onto the tank opening, the film extends beyond its edge, thereby effectively closing off the tank opening. To remove the perforated region, the bottle is tilted at its shoulder region, to provide free movement for the pull cord. Pulling the cord causes the perforated region of the film to tear away, thereby allowing the water within the bottle to pass through the mouth of the bottle and into the water cooler tank. Since the shield is now in place between the bottle and the interior of the tank, being firmly captured by the retention cap and by the pressure of the shoulder region of the bottle against the perimeter of the tank opening, the interior of the tank is completely shielded from the intrusion of contamination that may be present on the external surface of the bottle.

11 Claims, 2 Drawing Sheets

SANITATION SHIELD FOR WATER COOLER BOTTLE

CROSS REFERENCE TO RELATED APPLICATION

The present application is a continuation-in-part of application Ser. No. 319,482, filed Apr. 12, 1989, now abandoned.

FIELD OF THE INVENTION

The present invention relates in general to container opening attachments and is particularly directed to a protective shield that attaches to the mouth of a water cooler bottle, and prevents contaminant material that may be present on the outside of the bottle from falling into the water cooler tank when the bottle is installed in an inverted position over an opening in the water cooler tank.

BACKGROUND OF THE INVENTION

Water coolers, which are commonplace throughout business and industry, typically employ a large capacity (e.g. five-gallon) water bottle. During transport to the customer's premises, the water bottles are usually carried on an open truck bed and thereby exposed to contaminants such as automobile exhaust, road grime and other atmospheric pollutants. Moreover, during handling by installation personnel, the external surface of the bottle is exposed to communicable disease organisms. When a replacement bottle is to be installed in the water cooler, the empty (inverted) bottle is lifted off the rim of the opening in the water tank. Then, with the new bottle being lowered into the tank, the installer holds the cap against the mouth of the bottle and removes the cap as the shoulder region of the bottle comes to rest on the circular rim of opening of the tank, as diagrammatically illustrated in FIG. 1. Namely, the bottle 10 is installed such that it is supported at its shoulder region 12 around the rim or perimeter 14 of the opening 16 in the top of the water cooler tank 18. Because a substantial portion of the upper portion of the bottle, specifically its neck 15 and shoulder regions 14, is exposed through opening 16, there is nothing to prevent contaminants on these exposed bottle surfaces from falling into the cooler tank.

A commonplace household procedure is to simply wipe off the bottle before installation. A problem with this sanitizing effort is that, in the course of cleaning the bottle, there is further contact with the surfaces of the bottle to which the tank water will be exposed. Moreover, most water cooler bottles are currently made of plastic, which, in practice, cannot be hygienically cleaned. As a consequence, the condition of the installed water bottle is still less than sanitary.

SUMMARY OF THE INVENTION

In accordance with the present invention, the potential health hazards created by transport and installation procedures for water cooler bottles are remedied by a new and improved sanitation shield which covers the neck and shoulder regions of the bottle and effectively insulates the interior of the cooler tank from contaminants that may have accumulated on the bottle during transport and handling.

In accordance with a preferred embodiment of the present invention, the water cooler tank is effectively shielded against the introduction of contaminant material, that may be present on the outer surface of the water bottle, by means of a film of non porous material (e.g. mylar plastic film) that is secured around the mouth of the bottle by an annular retention cap. The film has a perforated region for placement over the mouth of the bottle and a pull cord attached to the perforated region. The film is sized so that, when the bottle is inverted and lowered onto the tank opening, the film extends beyond its edge, thereby effectively closing off the tank opening.

During installation of a new bottle, the film is placed over the mouth, neck and shoulder region of the bottle, so that the perforated region is located over the mouth of the bottle. The annular retention cap, which preferably comprises a snap-on configuration, has an opening through which the perforated region of the film extends, beyond the end of the mouth of the bottle, so that the film is captured around and across the mouth of the bottle and extends over the shoulder region of the bottle. The pull cord contains a stick-on fastener for securing one end of the cord to the bottle as the bottle is inverted and placed over the opening in the cooler tank. The inverted bottle is lowered onto the rim of the opening of the cooler tank, so that the neck of the bottle extends into the opening of the tank and the bottle is supported against the film shield at its shoulder region around the perimeter of the tank opening. To remove the perforated region, the bottle is then tilted at its shoulder region, thereby providing free movement for the pull cord through the opening in the tank. Pulling the cord causes the perforated region of the film to tear away, thereby allowing the water within the bottle to pass through the mouth of the bottle and into the water cooler tank. The pull cord and torn away perforated region of the shield are then discarded and the bottle is tilted back to its normal inverted position. Since the shield is now in place between the bottle and the interior of the tank, being firmly captured by the retention cap and by the pressure of the shoulder region of the bottle against the perimeter of the tank opening, the interior of the tank is completely shielded from the intrusion of contamination that may be present on the external surface of the bottle.

DETAILED DESCRIPTION

Figure 1:
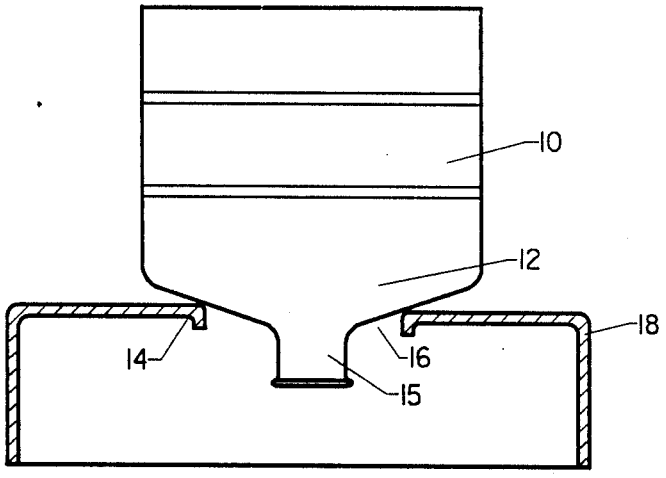
FIG. 1 diagrammatically shows an unshielded water bottle supported upon the circular rim of the opening of a water cooler tank.
Figure 2:
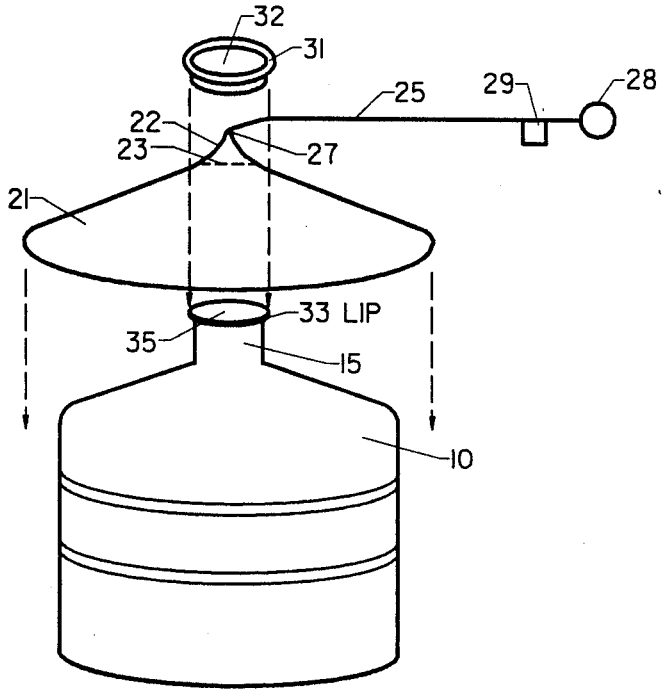
FIG. 2 is a diagrammatic pictorial arrangement of the components of the sanitation shield in accordance with the present invention.

Referring now to FIG. 2, a diagrammatic pictorial arrangement of the components of the sanitation shield in accordance with the present invention is depicted as comprising a thin shroud 21 of non porous material, such as a circular sheet of mylar plastic film, having a circular perforation 23 at a central portion 22 of the film and a pull cord or string 25, one end of which is attached (e.g. adhesively bonded) to a folded or pinched portion 27 of the central portion of the perforated region of the shroud. A second end of the pull cord 25 preferably has pull tab or ring 28, and a stick-on fastener (e.g. adhesive tape fastener) 29 for securing the pull cord to the side of the bottle during installation of the bottle into the cooler. Shroud 21 is sized so that its skirt portion 24 is at least as wide as the shoulder region of the bottle. As a consequence, when the bottle is inverted and lowered onto the tank opening, the skirt portion 24 of the shroud extends over the shoulder of the bottle and beyond the edge of the opening in the tank, thereby effectively closing it off.

Shroud 21 is secured to bottle 10 by means of an annular retention cap 31, that is preferably configured to 'snap-on' the lip region 33 of the mouth 35 of bottle 10. Retention cap 31 has an opening 32, the diameter of which substantially corresponds to that of the mouth of the bottle, so that the perforated central portion 22 of the shroud readily passes through the opening in the retention cap.

Figure 3:
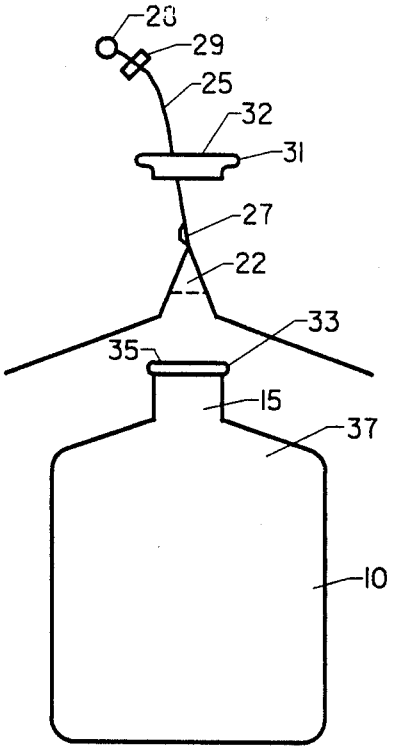
FIG. 3 diagrammatically shows the arrangement of the components of the sanitation shield of the present invention prior to installation of a new bottle in the water cooler tank.

As diagrammatically shown in FIG. 3, prior to installation of a new bottle in the water tank, shroud 21 is placed over the mouth 35, neck 36 and shoulder regions 37 of bottle 10, so that the central perforated portion 22 is located over the mouth 35 of the bottle. To prevent any contamination, the individual changing the bottle places his hand between bottle 10 and shield 21. Retention cap 31 is then placed over the mouth of the bottle such that the perforated portion 22 of the shroud and pull cord 25 pass through the opening 32 in the cap. The cap is then 'snapped on' the lip 33 of the mouth 35 of the bottle, so that the central portion of the shroud is captured around and across the mouth of the bottle and its skirt portion 24 extends over the shoulder region 37 of the bottle. Stick-on fastener 29 is then attached to the body of the bottle below the shoulder portion for securing the cord to the bottle as the bottle is inverted and placed over the opening in the cooler tank.

Figure 4:
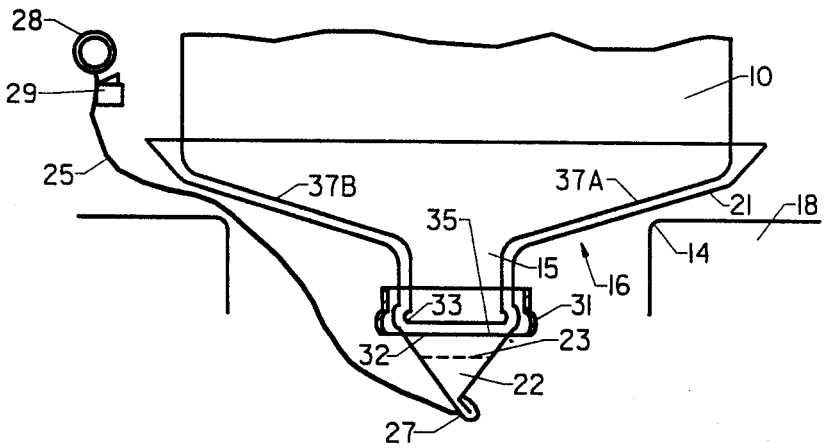
FIG. 4 diagrammatically shows an inverted bottle having the sanitation shroud of the present invention supported upon the rim of an opening of a water cooler tank.

Next, as diagrammatically illustrated in FIG. 4, (inverted) bottle 10 is lowered onto the rim 14 of opening 16 of the cooler tank 18, so that neck 16 of the bottle extends into the opening of the tank and the bottle is supported against the film shield 21 at its shoulder region 37 around the perimeter or rim 14 of the tank opening. To remove the central perforated portion 22 of the film shield 21, bottle 10 is preferably tilted at shoulder region 37A, thereby providing free movement for pull cord 25 through the opening in the tank adjacent shoulder region 37B. Pulling cord 25 causes the central portion 22 of shield to tear away along perforation 23, thereby allowing the water within the bottle to pass through the mouth 35 of the bottle and into water cooler tank 18. The pull cord and torn-away, perforated region of the shield are then discarded and the bottle is tilted back to its normal inverted position, being supported completely around its shoulder region. Since shield 21 is now in place between the bottle and the interior of the tank, being firmly captured by the retention cap and by the pressure of the shoulder region of the bottle against the perimeter of the tank opening, the interior of the tank is completely shielded from the intrusion of contamination that may be present on the external surface of the bottle.

As will be appreciated from the foregoing description, the potential health hazards created by transport and installation procedures for water cooler, especially non sanitizable plastic bottles, are remedied by the sanitation shield configuration of the present invention, which covers the neck and shoulder regions of the bottle. Once the shield is in place between the bottle and the interior of the tank, being firmly captured by the retention cap and by the pressure of the shoulder region of the bottle against the perimeter of the tank opening, the interior of the tank is completely shielded from the intrusion of contamination that may be present on the external surface of the bottle.

While I have shown and described an embodiment in accordance with the present invention it is to be understood that the same is not limited thereto but is susceptible to numerous changes and modifications as known to a person skilled in the art, and I therefore do not wish to be limited to the details shown and described herein but intend to cover all such changes and modifications as are obvious to one of ordinary skill in the art.

What is claimed:

1. For use with a water bottle which, when installed in a water cooler, is placed in an inverted position over an opening in the water cooler tank, a device for effectively shielding the water cooler tank from contaminant material that may be present on the outside of the water bottle comprising:

a shroud of non porous material sized to extend over the mouth, neck and shoulder region of said water bottle, so that, when said bottle is supported over said opening in the water cooler tank, said shroud extends beyond the edge of said opening, said shroud having a removable region for placement over the mouth of the bottle;

a retainer cap having an opening through which the removable region of said shroud extends, said retainer cap cooperating with the mouth of said bottle, so that said shroud is retained thereby and extends over the shoulder region of said bottle; and means, attached to the removable region of said shroud, for removing the removable region of said shroud, thereby allowing the contents of said bottle to pass through the mouth of the bottle and into the water cooler tank.

2. A device according to claim 1, wherein said retainer cap comprises an annular cap that snaps onto the mouth of the water bottle and said shroud comprises non porous film having a removable perforated region to which said removing means is attached.

3. A device according to claim 2, wherein said removing means comprises a pull cord that extends at least from the mouth to beyond the shoulder of the bottle and contains a stick-on fastener for securing one end of the cord to the bottle.

4. A device according to claim wherein said shroud comprises a plastic film.

5. A method of effectively shielding a water cooler tank from contaminant material that may be present on the outside of a water bottle which, when installed in a water cooler, is placed in an inverted position over an opening in the water cooler tank, comprising the steps of:

(a) providing a shroud of non porous material having a removable region for placement over the mouth of the bottle and a pull cord attached to said removable region of said shroud;

(b) placing said shroud over the mouth, neck and shoulder region of said water bottle, so that said removable region is located over the mouth of said bottle;

(c) securing said shroud to the mouth of said bottle by attaching a retainer cap, having an opening through which the removable region of said shroud extends, to the mouth of said bottle, whereby said shroud is retained thereby and extends over the shoulder region of said bottle;

(d) inverting said bottle, to the mouth of which said shroud has been secured by means of said retainer cap, and placing the inverted bottle upon said water cooler tank so that the neck of the bottle extends into the opening of the water cooler tank; and (e) pulling said pull cord, thereby removing the removable region of said shroud, and allowing the contents of said bottle to pass through the mouth of the bottle and into the water cooler tank.

6. A method according to claim 5, wherein step (e) comprises tilting the inverted bottle to provide free movement of said pull cord through the opening in said water cooler tank, and pulling said cord so as to remove said removable region of said shroud, thereby allowing the contents of said bottle to pass through the mouth of the bottle and into the water cooler tank.

7. A method according to claim 5, wherein said retainer cap comprises an annular cap that snaps onto the mouth of the water bottle, and wherein said pull cord contains a stick-on fastener for securing one end of the cord to the bottle as the bottle is inverted and placed over the opening in said water cooler tank.

8. A method according to claim 5, wherein said retainer cap comprises an annular cap that snaps onto the mouth of the water bottle and said shroud comprises non porous film having a removable perforated region to which said pull cord is attached.

9. A method according to claim 5, wherein said shroud comprises a plastic film.

10. A method of effectively shielding a water cooler tank from contaminant material that may be present on the outside of water bottle which, when installed in a water cooler, is placed in an inverted position over an opening in the water cooler tank, so that the water bottle is supported at a shoulder region of the bottle at the perimeter of said opening, comprising the steps of:

(a) providing a film of non porous material having a perforated region for placement over the mouth of the bottle and a pull cord attached to said perforated region of said film, said film being of a size, so that, when said bottle is supported over said opening in the water cooler tank, said film extends beyond the edge of said opening;

(b) placing said film of non porous material over the mouth, neck and shoulder region of said water bottle, so that said perforated region is located over the mouth of said bottle;

(c) securing said film to the mouth of said bottle by attaching a retainer cap, having an opening through which the perforated region of said film extends, to the mouth of said bottle, whereby said film is retained thereby and extends over the shoulder region of said bottle;

(d) inverting said bottle, to the mouth of which said film has been secured by means of said retainer cap, and placing the inverted bottle upon said water cooler tank, so that the neck of the bottle extends into the opening of the water cooler tank and so that the water bottle is supported against said film at its shoulder region at the perimeter of said opening; and (e) tearing away the perforated region of said film by tilting the inverted bottle at its shoulder region, and thereby provide free movement of said pull cord through the opening in said water cooler tank, and pulling said cord so as to cause said perforated region of said film to tear away, thereby allowing the contents of said bottle to pass through the mouth of the bottle and into the water cooler tank.

11. A method according to claim 10, wherein said retainer cap comprises an annular cap that is snapped onto the mouth of the water bottle, and wherein said pull cord contains a stick-on fastener for securing one end of the cord to the bottle as the bottle is inverted and placed over the opening in said water cooler tank, and wherein step (c) comprises attaching said stick-on fastener to a portion of said bottle beyond its shoulder region, prior to installing the bottle in its inverted condition over the opening in said water cooler, so as to facilitate grasping said one end of said pull cord after said bottle has been installed in said water cooler and tilted to permit the tearing away of the perforated region of said film.

* * * * *